United States Patent [19]

Karageorgiou

[11] Patent Number: 4,983,448

[45] Date of Patent: Jan. 8, 1991

[54] POLYAMIDE FILAMENTS HAVING IMPROVED PROPERTIES AND METHOD OF PREPARATION

[75] Inventor: Theodore G. Karageorgiou, Arden, N.C.

[73] Assignee: BASF Corporation, Williamsburg, Va.

[21] Appl. No.: 203,659

[22] Filed: Jun. 7, 1988

[51] Int. Cl.[5] ..... D02G 3/00

[52] U.S. Cl. ..... 428/224; 57/243; 428/364; 428/373

[58] Field of Search ..... 428/364, 224; 57/243

[56] References Cited

U.S. PATENT DOCUMENTS 4,369,155 1/1983 Schilo et al. ..... 264/210.8 X 4,539,170 9/1935 Hare ..... 264/176

4,542,063 9/1985 Tanji et al. ..... 264/210.8 X 4,702,875 10/1987 Jennings ..... 264/210.8 X

*Primary Examiner*—Lorraine T. Kendell

*Attorney, Agent, or Firm*—Karen M. Dellerman; Edward F. Sherer

[57] ABSTRACT

A polyamide filament having improved properties such as increased tenacity and dyeability. The filament has a birefringence of at least 0.040 and an α-crystal content of at least 30%. The filament is prepared by contacting the filament with water after the filament has been cooled to a temperature below its stick point but above its glass transition temperature. The water can be applied intermittently to the filament to produce a resulting filament having variable dyeing characteristics.

6 Claims, 15 Drawing Sheets

POLYAMIDE FILAMENTS HAVING IMPROVED PROPERTIES AND METHOD OF PREPARATION

BACKGROUND OF THE INVENTION

This invention relates to polyamide filaments having improved properties including increased fiber strength, dyeability, and cohesiveness; and a method of producing the filaments.

Polyamide filaments and yarns made therefrom have excellent mechanical, chemical, and aesthetic properties and, thus, find widespread use in the home and industry, including carpets, drapery material, upholstery, and clothing.

In a conventional prior art process for preparing polyamide filaments, molten polyamide is extruded through spinnerette orifices into a quench zone, such as a vertical tower, to form filaments which are then cooled to a non-tacky state by a cross-flow of air. The solidified filaments are then withdrawn from the quench zone, lubricated, and then either wound up for further processing or further processed such as by drawing, texturing, etc., prior to being wound up (continuous process).

Many of the polyamide filaments and resulting yarns produced from conventional processes have been found to be deficient in certain properties, i.e., strength, residual shrinkage, cohesiveness, dyeability, etc.

The combined objective of polyamide filaments having good strength, acceptable dyeability and cohesiveness is somewhat irreconcilable in many of the prior art processes. An improvement in one of the properties many times comes about through some compromise of another. Similarly, opposed interactions are also found when attempting to optimize properties.

The present invention involves polyamide filaments having the improved combination of properties, yarns made therefrom, and a method of making the filaments.

SUMMARY OF THE INVENTION

It has been surprisingly discovered that polyamide filaments having the improved combination of properties can be prepared by applying water to the filaments after the temperature of the filaments has been cooled to below their stick point, but above their glass transition temperature.

The resulting polyamide filaments have a birefringence ($\Delta n$) in the range of from about 0.0385 to about 0.0405, an $\alpha$-crystal content greater than 30%, preferably from about 35 to about 42 per cent, and a tenacity of at least 4.6 grams per denier, preferably from about 4.8 to about 5.1 and, most preferably, about 5.0. The boiling water shrinkage of the filaments is usually at least 9.2%.

BRIEF DESCRIPTION OF THE DRAWINGS

FIGS. 2 through 15 represent graphs showing the results of the Examples, wherein:

FIGS. 2 and 3 show the effect of water application location and elongation of the filaments;

FIGS. 4 and 5 show the effect between water application location and tenacity of the filaments;

FIGS. 6 and 7 show the effect between water application location and modulus of the filaments.

FIGS. 8 and 9 show the effect between water application location and boiling water shrinkage of the filaments.

FIG. 10 shows the effect between water application location and Uster uniformity of the filaments;

FIG. 11 shows the effect between water application location and $\alpha$-crystalline content of the filaments;

FIG. 12 shows the effect of water application location and birefringence of the filament.

FIG. 13 shows the effect of water application location on elongation and tenacity of the filaments and their interrelationship with respect to the filament;

FIG. 14 shows the effect of water application location on modulus and boiling water shrinkage on the filaments and their interrelationship with respect to the filaments;

FIG. 15 shows the effect between water application location and dyeability of the filaments.

DESCRIPTION OF THE PREFERRED EMBODIMENTS

Figure 1:
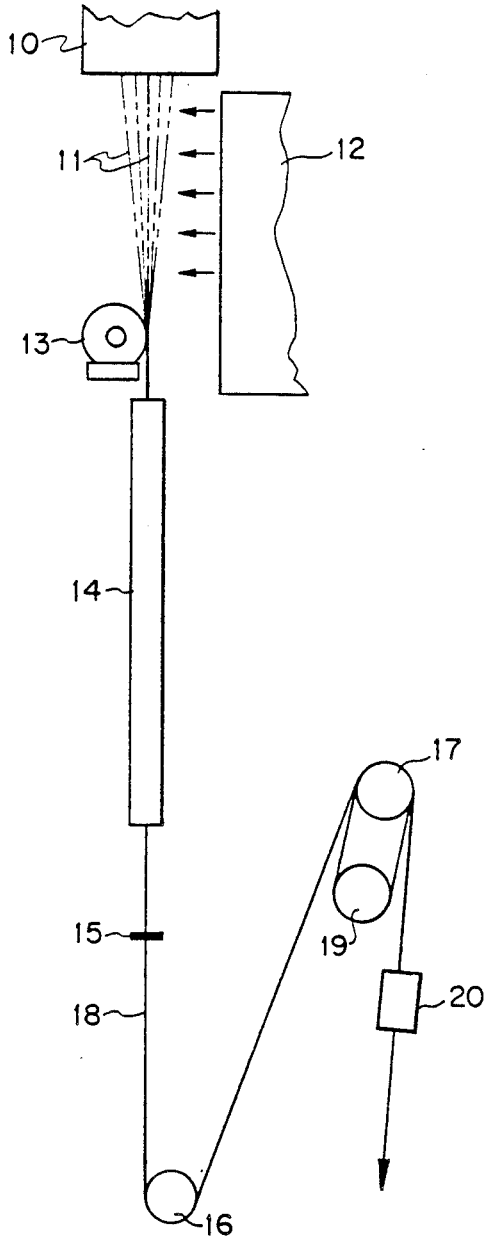
FIG. 1 represents a partial schematic of a process utilized in preparing the polyamide filaments.

In accordance with the invention, the polyamide filaments are preferably prepared by melt-spinning one or more filaments at an extrusion temperature above the polyamide melting point into a quench zone or stack which is cooled by air, applying water having a temperature in the range of from about 15° to about 40° C. and which, optionally, contains a water-soluble finish composition, to the filaments after the temperature of the filaments which is below their stick point, but above their glass transition temperature. After the application of the water to the filaments, the filament can be wound up for processing at a later time or further processed, such as by drawing, texturing, etc., prior to being or wound up onto a pirn. The take-up speed of the yarn during the processing is generally in the range of from about 4,000 to about 6,000 meters/minute and, preferably, from about 4,200 to about 5,500 m/minute.

Although the invention is not intended to be limited to any theory of operation, it is believed that the improved properties of the polyamide filaments are due to an increase in the molecular orientation of the amorphous regions of the filaments. In addition, the filaments have an increased amount of $\alpha$-type crystalline content, which could also contribute to the improved properties. In addition, darker dyeing of the filaments was believed due to microvoids in the amorphous regions of the filament, which enhance the penetration of the dye into the filament. Regardless of the theories proposed, the filaments have the improved properties which are disclosed herein.

As used herein, the term "stick point" means that the filaments are in a tacky state. Hence, below that point, the filaments are in a non-tacky state.

The term "fiber" as used herein includes fibers of extreme or indefinite length (i.e., filaments) and fibers of short length (i.e, staple). The term "yarn" as used herein means a continuous strand of fibers.

The term "glass transition temperature" ($T_g$) means the temperature at which an amorphous polymer or the amorphous regions of a partially crystalline polymer changes to or from a hard and relatively brittle state to a more flexible or rubbery condition. At sufficiently low temperatures, all amorphous polymers or amorphous regions of semicrystalline polymers assume characteristics of glasses, such as hardness, stiffness, and brittleness. Polymers in the glassy state are characterized by a low volume coefficient of expansion, when compared with that of the polymer in the fluid state. In this respect, polymers in the glassy state resemble crystalline polymers which are also characterized by a low volume coefficient of expansion. The temperature interval at which the volume coefficient of expansion of the amorphous polymer changes from a high to a low value is the glass transition temperature range. The glass transition temperature of a polymer cannot be defined as a specific temperature. In fact, the glass transition temperature of a polymer is rate-dependent, i.e., it is dependent on the rate of heating or cooling of the polymer during the analytical determination of the volume coefficient of expansion. The faster the rate of heating or cooling of the polymer during analysis, the wider will be the range of glass transition temperature. The opposite relationship pertains when the sample is heated or cooled slowly. In view of this rate dependence, specific glass transition temperatures refer to the midpoint of the glass transition temperature range.

While the invention is not limited to any particular polyamide molecule, the preferred polyamides include polycaprolactam, which is also known as nylon 6, and polyhexamethylene adipamide, which is also known as nylon 66. In addition, copolymers comprising different polyamide monomeric components or polyamide monomeric components as major constituents (e.g., at least 50% by weight) with another compatible monomer can also be utilized.

Furthermore, the filaments may contain small amounts of additives such as delustrants, antistatic agents, brighteners, antioxidant, and the like.

Referring to FIG. 1, a number of filaments (11) are spun from a conventional spinnerette or spinnerettes (10) having a plurality of orifices into a quench zone where they are cooled by a cross-flow of quenching air, preferably having a temperature of between 12° C. and 37° C. and a volumetric rate of between about 90 and 150 cubic feet per minute (hereinafter CFM) supplied by quench chamber (12). Spin head temperatures may vary, but will generally be in the range of from about 260° C. to 295° C. The individual filaments of yarn can have any cross-sectional configuration such as round, oval, multilobal, Y-shaped, polygonal, or combinations thereof. The filaments are preferably extruded from the spinnerette at a rate of from about 3 pounds per hour per end of yarn. The rate, however, will vary depending on the denier and number of filaments in the yarn.

After the filaments have been quenched, they are contacted with water preferably having a temperature in the range of from about 23° to about 36° C. after their temperature is below their stick point, but above the glass transition temperature by means of applicator (13), which is depicted as a kiss roll. Preferably, the water also contains a water-soluble lubricating finish composition. Such compositions are known to persons skilled in the art. Next, the filaments preferably pass through interfloor tube (14). This early convergence system minimizes the potential in yarn tension due to frictional resistance of air caused by air dragging on the yarn at the high speed of the solidified filaments. After passing through the tube (14), the yarn end (18) preferably passes through one or more guides (15). Thereafter, the yarn can either be taken up directly or can be further processed by passing the yarn over godet (16) and taking up the yarn and drawing it, by means of godets (17) and (19), at a draw ratio in the range of from about 1.05 to about 2.0, more preferably in the range of from about 1.20 to about 1.35 and, most preferably, about 1.3 and at ambient temperature. At this point, the yarn can be steam interlaced by means of steam interlacing chamber (20) and wound onto a pirn (not shown).

The yarn produced in accordance with the invention has filaments having a wide range of denier, i.e., 1.5 to 5, with no limitations, and the total denier of the yarn, preferably, will be in the range of from about 40 to about 140.

In another embodiment of the invention, polyamide filament and resulting yarn can be produced having variable dyeing characteristics (dark and light shades), which will be observed for disperse dyes. Thus, a practitioner of this invention can prepare a polyamide filament which will be differentially dyeable using only one dye bath. The dark and light dyeing patterns can be either random or controlled. These yarns are utilized to make fabrics with a special appearance. This embodiment of the invention is carried out by spot quenching the filaments after the temperature of the filaments has been cooled to below their stick point, but above their glass transition temperature. Thus, the portion of the filaments not contacted with water will have normal dyeing characteristics, while the portion contacted with the water will be darker dyeing to disperse dyes. Procedures for applying the water intermittently to the filaments are known to persons skilled in the art. One such procedure comprises utilizing an eccentric kiss roll. The length of the darker dyeing sections will generally be determined by the length of the surface of the kiss roll and its speed. Many times, the darker dyeing sections of the yarn will be from about ½ inch to 5 inches.

The apparatus for spinning the filaments of the present invention preferably comprises a spinnerette for spinning the filaments, a quench stack, a cross-flow quench stack, and an applicator for applying the water to filament at the proper location, a means for supplying a flow of air to the quench stack, means of exhausting the air flow from the quench stack, a means of supplying water to the applicator, and a means for controlling air flow.

Preferably, water will contact the filaments after they have been cooled below their stick point but above their glass transition temperature at a distance in the range of from about 50 to about 85 cm and, more preferably, about 65 to about 75 cm below the spinnerette. Since the optimum distances are dependent on the rate of cooling of the filaments, the optimum distances are sometimes outside of these ranges.

The invention is further exemplified by the example below, which is presented to illustrate certain specific embodiments of the invention, but is not intended to be construed so as to be restrictive of the scope and spirit thereof.

EXAMPLE

Various characteristics and measurements are utilized throughout the Example. These characteristics and measurements are grouped here for convenience, although most are standard.

Birefringence ($\Delta n$) is obtained in the following manner:

Sodium D rays (wavelength 589 millimicrons) are used as a light source, and filament specimens are disposed in a diagonal position. The birefringence ($\Delta n$) of the specimen is computed from the following equation:

$$\Delta n = \frac{n\lambda + r}{\alpha}$$

when n is the interference fringe due to the degree of orientation of the polymer molecular chain; r is the retardation obtained by measuring the orientation not developing into the interference fringe by means of a Berek's compensator; $\alpha$ is the diameter of the filament; and $\lambda$ is the wavelength of the sodium D rays.

The term "boiling water shrinkage (BWS)" is defined as "percent decrease in length of material when exposed to elevated temperatures for a period of time and under 0.05 (gpd) tension". In the present invention, the percent thermal shrinkage is measured in a boiling water bath of 100° C. for a period of 30 minutes. The shrinkage of the fiber is determined in accordance with the following formula:

$$\text{Shrinkage} = \frac{L_1 - L_2}{L_1}$$

wherein $L_1$ is original length of fiber; and $L_2$ is length of fiber after treatment.

The tenacity or breaking strength in grams per denier (UTS) is defined by ASTM Standards, Part 24, American Society for Testing and Materials, 1916 Race Street, Philadelphia, PA., page 33 (1965) as "the maximum resultant internal force that resists rupture in a tension test" or "breaking load or force, expressed in units of weight required to break or rupture a specimen in a tensile test made according to specified standard procedure."

In order to determine the amount of $\alpha$-type crystal structure in the filaments, x-ray measurements were taken and $\alpha$-type crystal structure was determined from equatorial x-ray diffraction peak widths at half peak height.

The amount of elongation of the filaments was determined by the stress-strain curves obtained by means of a Statimat instrument.

The term "modulus" is the coefficient of elasticity representing the ratio of strain to stress as the filament is deformed under a dynamic load. This characteristic was determined by stress-strain curve (at least 3% strain) as obtained by a Statimat instrument.

Dyestrength was determined by measuring dyed specimens on a MacBeth Spectrophotometer.

The term "Uster" is a measurement of uniformity (denier variation) of the filaments. The Uster was measured by means of Uster Evenness Tester, Model II, using the procedures recommended by the manufacturer.

A melt of polycaprolactam having a temperature of 280° C. was extruded at a rate of 21.4 gr./min. through a spinnerette. The filaments leaving the spinnerette were taken off at a spinning speed of about 4,231 meters per minute and advanced through a quench zone which utilized a cross-flow of air having a temperature of 12° C. or 37° C., which was supplied by a means of quench chamber. The filaments were then contacted by water having a temperature of 23° C. or 36° C. containing a water soluble finish composition at various distances below the spinnerette. The yarn was then drawn at a draw ratio of 1.3 and ambient temperature, introduced into a steam interlacer, and wound on a tube. For comparison purposes, filaments were prepared in the same manner without applying water thereto.

The filaments produced were subjected to measurements of elongation, tenacity, initial modulus, boiling water shrinkage, % Uster, % alpha content, birefringence ($\Delta$n), and dyestrength.

The symbols "△" and "▲" indicate that water was not applied to the filaments. The symbols "○" and "●" indicate water was applied to the filaments and the temperature of the water. The results of these tests are depicted in FIGS. 2 through 15.

Figure 2:
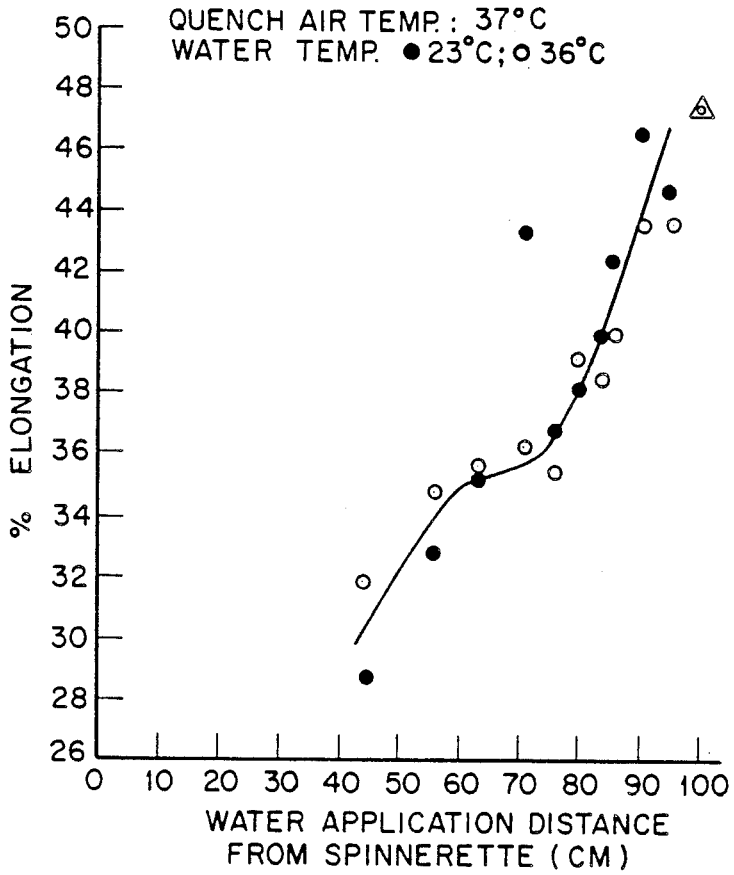
Figure 3:
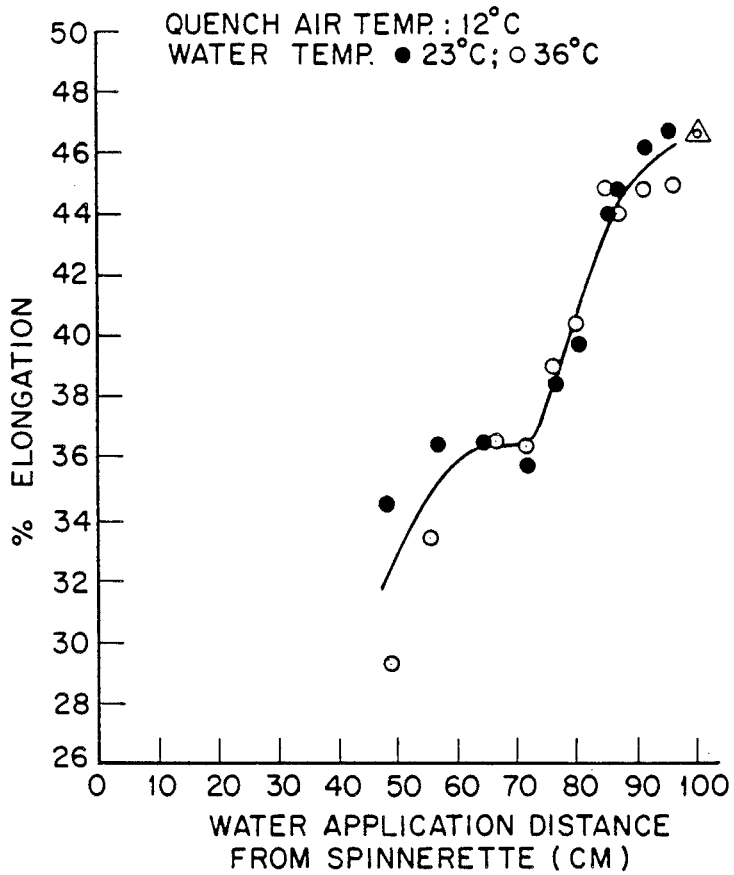
Figure 4:
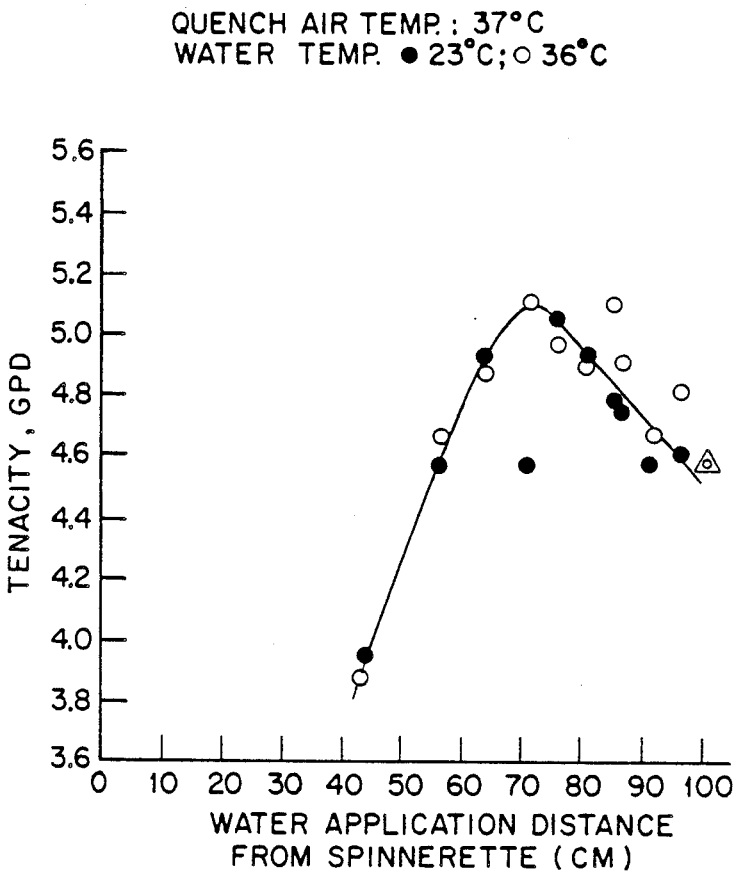
Figure 5:
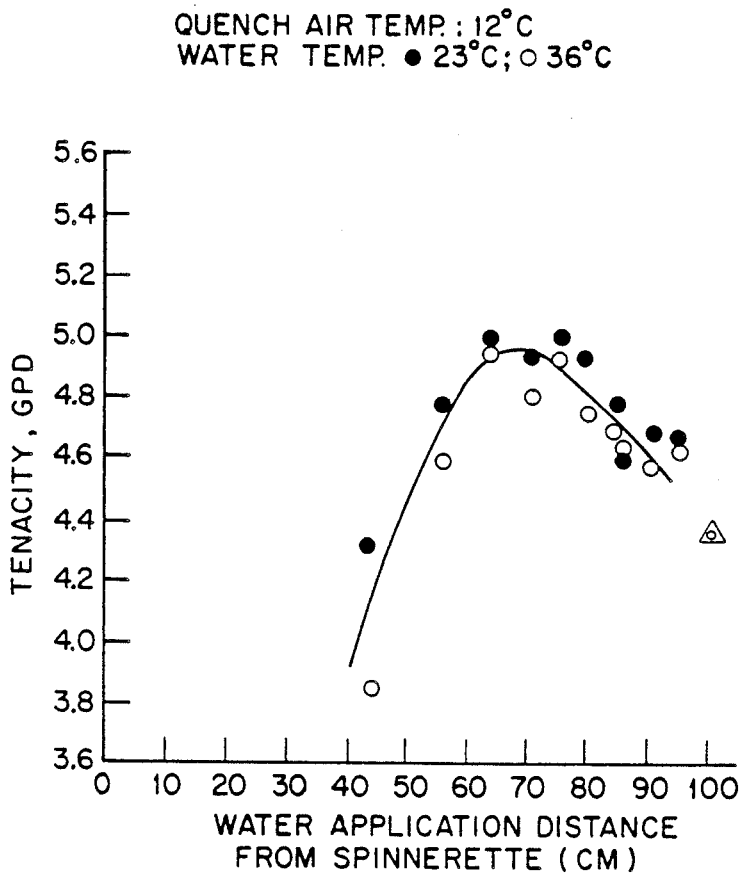
Figure 6:
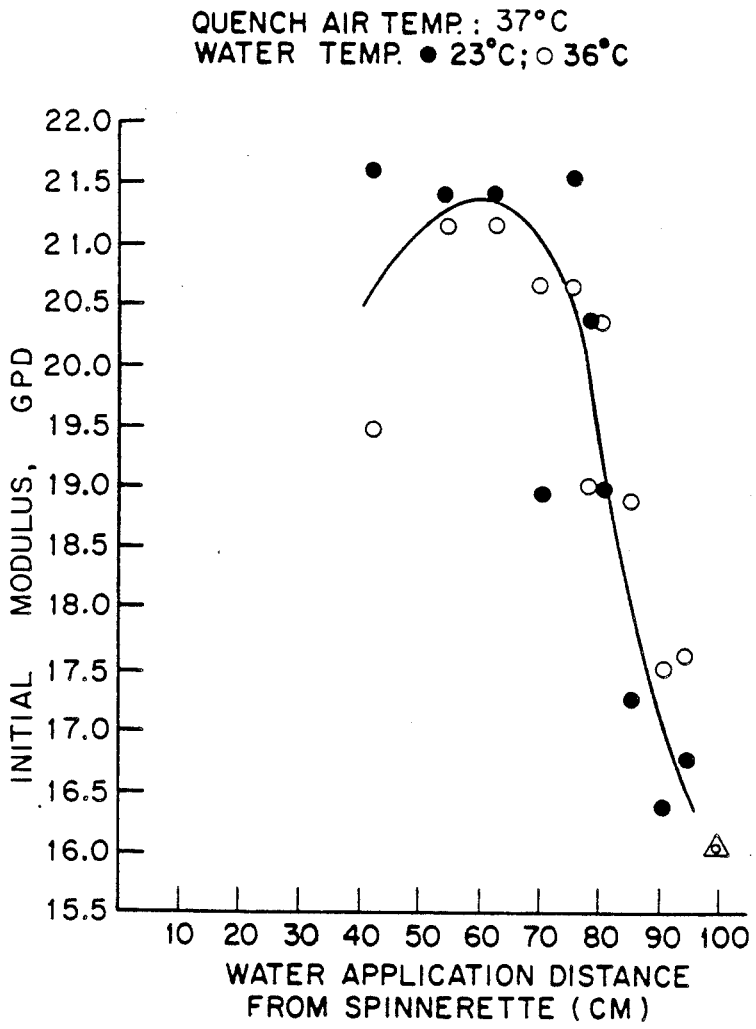
Figure 7:
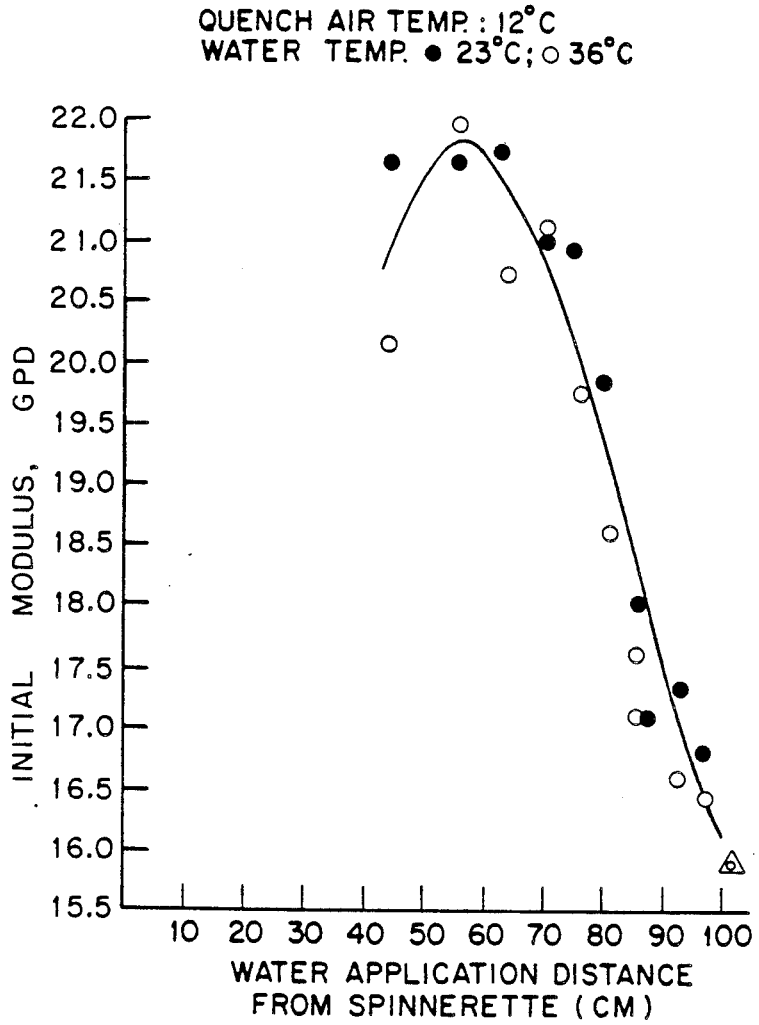
Figure 8:
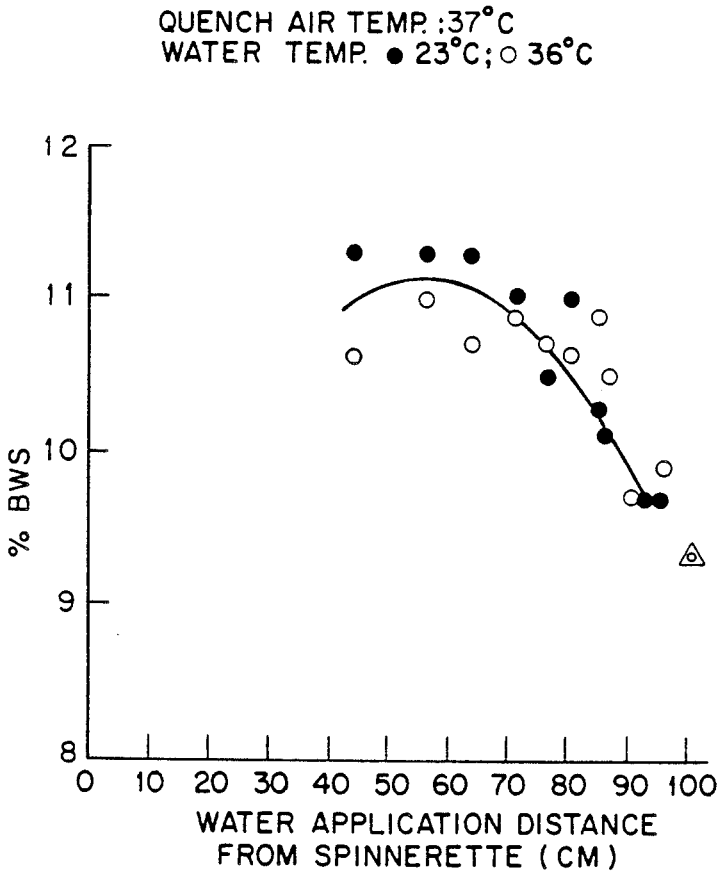
Figure 9:
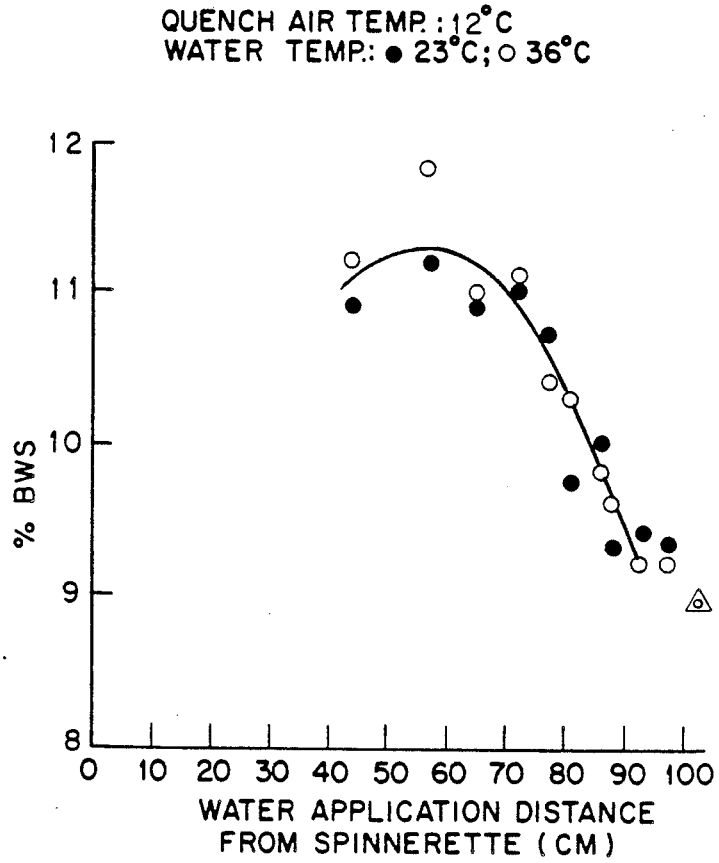
Figure 10:
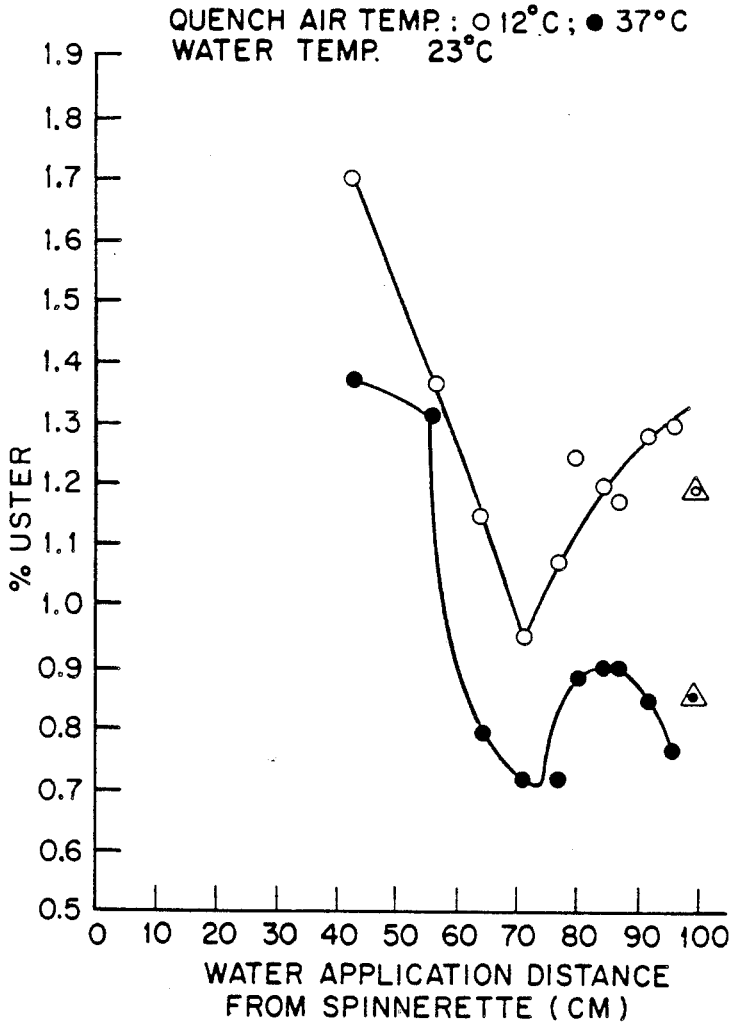
Figure 11:
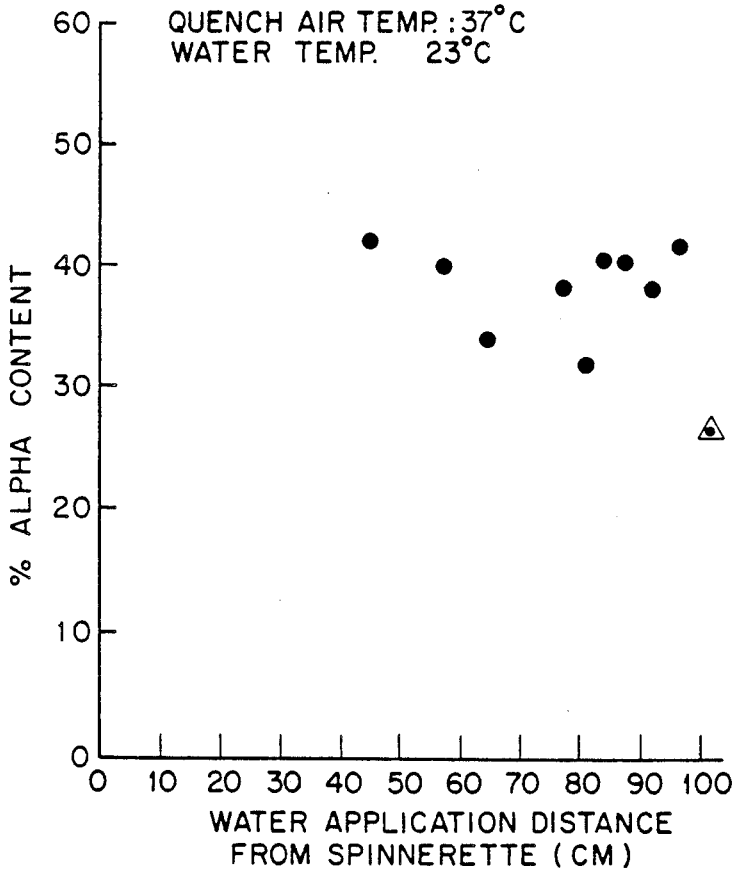
Figure 12:
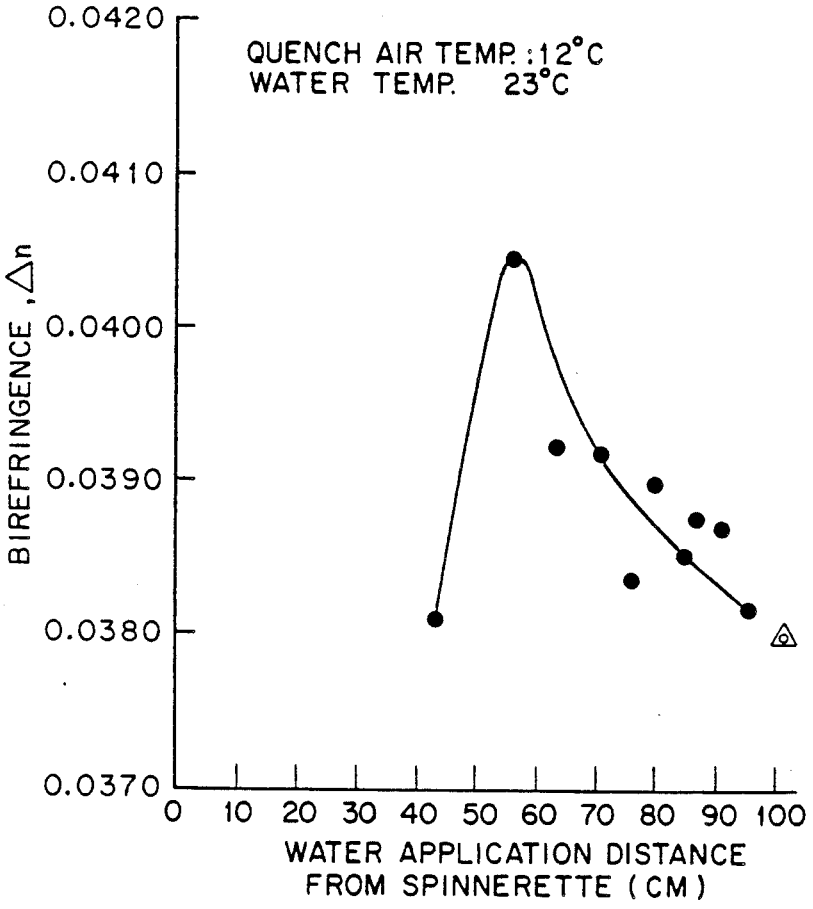
Figure 13:
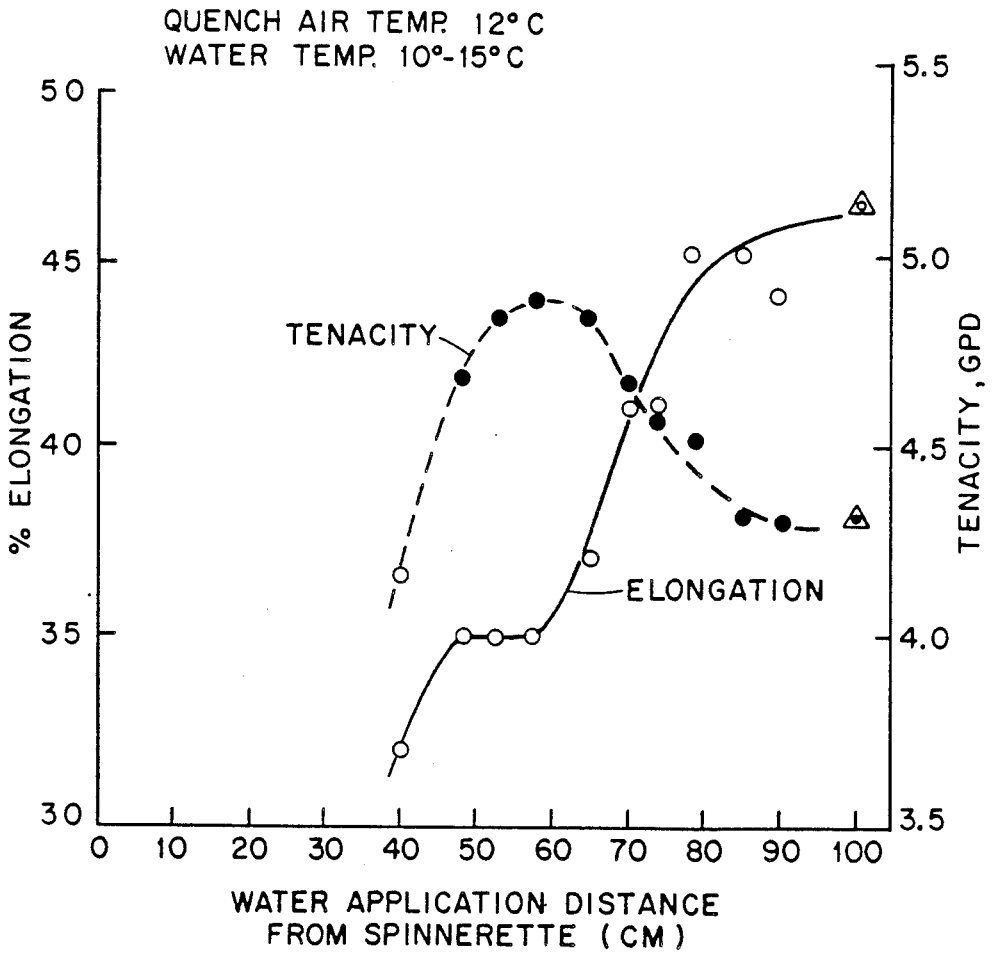
Figure 14:
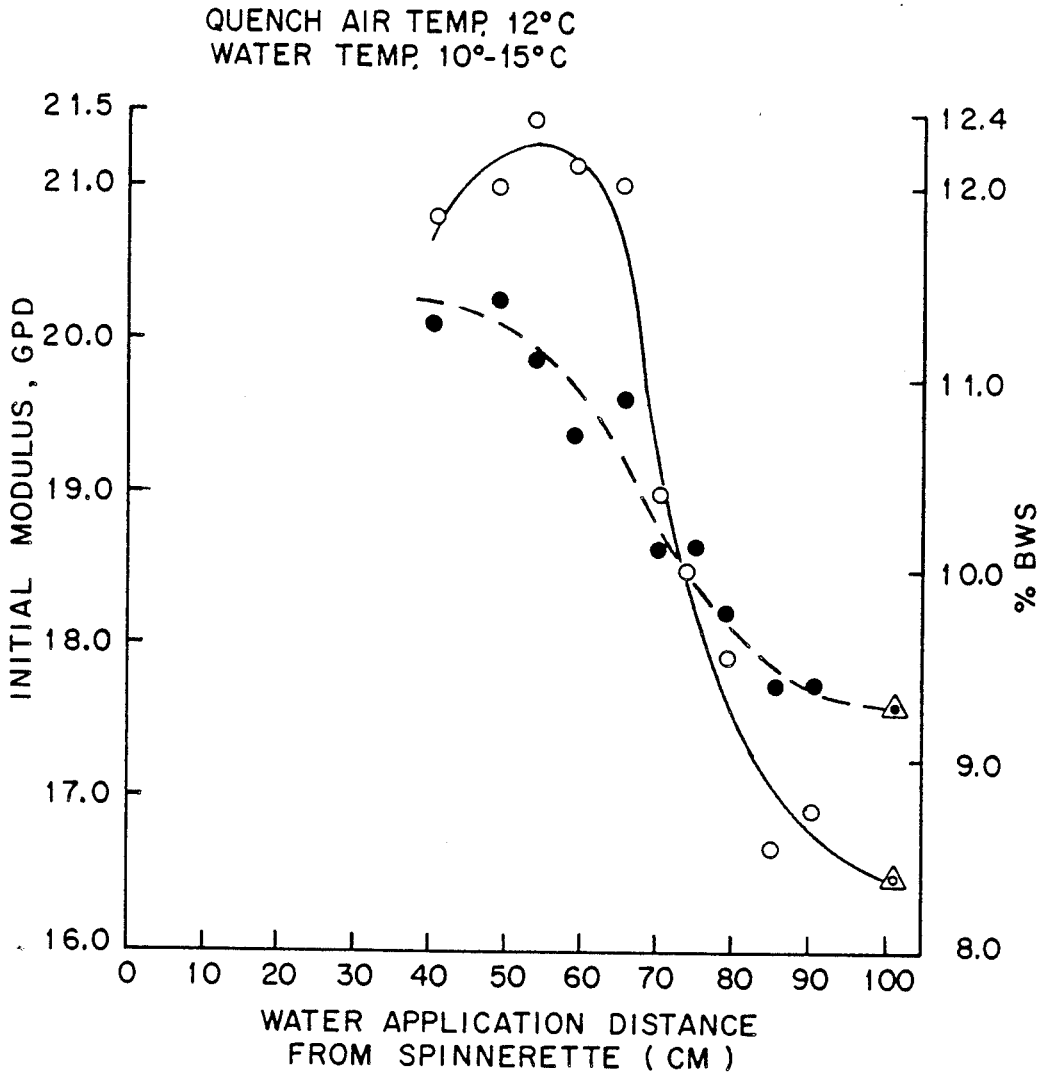
Figure 15:
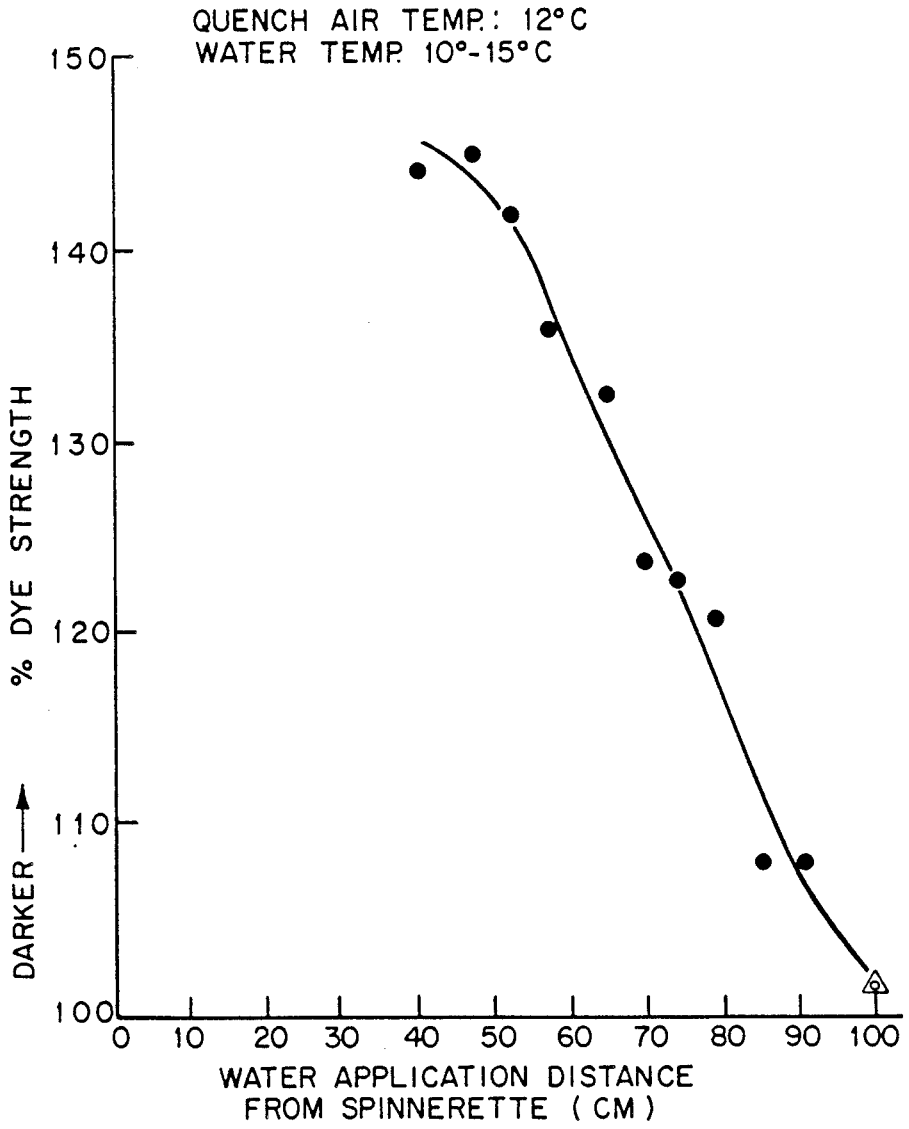

The results of the tests show that % elongation of the filaments decreased when water was applied to the filaments (FIGS. 2, 3, and 13). At the same time, tenacity (FIGS. 4, 5, and 13), modulus (FIGS. 6, 7, and 14), boiling water shrinkage (FIGS. 8, 9, and 14), and dye strength (FIG. 15) increased. The $\alpha$-crystalline content (FIG. 11) and birefringence (FIG. 12) of the filaments also increased when water was applied to the filaments below the stick point. The improved Uster (FIG. 10) of the filaments resulted in a reduction of drag during their spinning and winding.

Although certain preferred embodiments of the invention have been described for illustrative purposes, it will be appreciated that various modifications and innovations of the procedures and compositions recited herein may be affected without departure from the basic principles which underlie the invention. Changes of this type are therefore deemed to lie within the spirit and scope of the invention except as may be necessarily limited by the amended claims or reasonable equivalents thereof.

What is claimed is:

1. A polycaprolactam filament characterized by a birefringence in the range of from about 0.0385 to about 0.0405, an $\alpha$-crystal content greater than 30 percent, and a tenacity of at least 4.6 and up to about 5.1 grams per denier.

2. The filament recited in claim 1 wherein said $\alpha$-crystal content is an amount in the range of from about 35 to about 42 percent.

3. The filament recited in claim 3 wherein said filament has a denier of from about 1.5 to about 5.

4. The filament recited in claim 1, further characterized by having a boiling water shrinkage of at least 9.2%.

5. A yarn comprising filaments of claim 1.

6. A fabric comprising filaments of claim 1.

* * * * *